US006809698B2

(12) United States Patent
Tsai et al.

(10) Patent No.: US 6,809,698 B2
(45) Date of Patent: Oct. 26, 2004

(54) BROADBAND DUAL-FREQUENCY TABLET ANTENNAS

(75) Inventors: Churng-Jou Tsai, Tainan Hsien (TW); Ming-Hsiun Chong, Taipei (TW)

(73) Assignee: Antennigues Corp., Taipei Hsien (TW)

( * ) Notice: Subject to any disclaimer, the term of this patent is extended or adjusted under 35 U.S.C. 154(b) by 135 days.

(21) Appl. No.: 10/319,948

(22) Filed: Dec. 14, 2002

(65) Prior Publication Data

US 2004/0113858 A1 Jun. 17, 2004

(51) Int. Cl.[7] ..... H01Q 9/28

(52) U.S. Cl. ..... 343/795; 343/793; 343/792; 343/806

(58) Field of Search ..... 343/793, 792, 343/795, 803, 806, 807, 790, 791; H01Q 9/28

(56) References Cited

U.S. PATENT DOCUMENTS 6,337,666 B1 * 1/2002 Bishop ..... 343/795
6,483,471 B1 * 11/2002 Petros ..... 343/725
6,642,902 B2 * 11/2003 Gustafson ..... 343/791

* cited by examiner

*Primary Examiner*—Hoanganh Le

(57) ABSTRACT

A broadband dual-frequency tablet antenna comprises a set of dipole antennas, a baseplate, and an inductive investing-piece, in which a positive and a negative pole of the antenna-set disposed on the baseplate are composed of cambered narrow straps, respectively; the pole length is set about ¼λ (wavelength) of a low-frequency band while the space between poles is set about ¼λ (wavelength) of a high-frequency band; and the construction including the antenna and the baseplate is entirely invested in the inductive investing-piece. During application, by adjusting the cambered shape of the poles respectively, width of the narrow straps, interval between the narrow straps, and cooperating with inductance of the investing-piece, the harmonic bandwidth of said antenna could be widened to hence obtain the broadband dual-frequency function of the tablet antenna.

5 Claims, 7 Drawing Sheets

VSWR

Return Loss

H-Plane

E-Plane

BROADBAND DUAL-FREQUENCY TABLET ANTENNAS

FIELD OF THE INVENTION

This invention relates generally to an antenna, particularly an broadband dual-frequency tablet antenna.

BACKGROUND OF THE INVENTION

In the structure of a generic dipole antenna in ½λ (wavelength) shown in FIG. 1, the distance between a positive and a negative pole is theoretically the shorter the better in obtaining efficacy of signal transmission and reception.

Some conventional tablet dipole antennas are shown in FIGS. 2 and 3. In FIG. 2, the antenna is constructed by disposing a linear positive pole (signal end) 51 on a baseplate 50 and cambered negative poles by sides (earth end) 52, in which the positive and the negative poles 51, 52 are connected with the core 54 and the woven shield 55 of a coaxial cable 53, respectively. The antenna shown in FIG. 3 is constructed by assembling and disposing a linear positive pole (signal end) 61 on the back side and a piece of copper foil as a negative pole (earth end) 62 on the front side of a baseplate 60, in which the positive and the negative pole 61, 62 are connected with the core 64 and the metallic woven shield 65 of a coaxial cable 63, respectively.

The effective bandwidth of the conventional tablet antennas, which is defined as the quotient of an applicable band width divided by a center frequency, is about 5.0~10.0% limited to the ¼λ portion. Taking the frequency band of 2.4~2.5 GHz for instance, the signal bandwidth is only 100~240 MHz that limits the applicable range of the tablet antenna to a single frequency band, which is considered already out-of-date in catching the time pulses.

SUMMARY OF THE INVENTION

This invention is a broadband dual-frequency tablet antenna, comprising a set of dipole antennas, a baseplate, and an inductive investing-piece, in which the pole-set of the antennas disposed on the baseplate is composed of cambered narrow straps in length of ¼λ (wavelength) of a low-frequency band and spaced out in a distance of ¼λ of the center frequency in a high-frequency band. The entire dipole antenna construction and baseplate is thoroughly invested with an inductive investing piece.

The primary objective of this invention is to provide a set of dipole antennas for signal transmission and reception in a low-frequency band, and space out the antenna pole-set a ¼λ (wavelength) of a high-frequency band, such that a high-frequency harmonic oscillation will be brought about in response to that of a low-frequency band to thereby achieve the purpose for dual-frequency transmission and reception.

Another objective of this invention is to widen the bandwidth by adjusting: the cambered shape of the poles, the width of the narrow strap, the interval between the narrow straps, and using the inductance of the inductive investing-piece properly to increase the effective bandwidth to reach as high as 18% of the frequency band and thereby to obtain the efficacy of a broadband dual-frequency tablet antenna.

Yet another objective of this invention is to provide a broadband dual-frequency tablet antenna, in which a set of low-frequency poles is spaced out about ¼λ (wavelength) of a high-frequency band to therefore extend the antenna only by a length less than ¼λ of the high-frequency band.

For more detailed information regarding advantages or features of this invention, at least an example of preferred embodiment will be fully described below with reference to the annexed drawings.

BRIEF DESCRIPTION OF THE DRAWINGS

The related drawings in connection with the detailed description of this invention to be made later are described briefly as follows, in which.

DETAILED DESCRIPTION OF THE INVENTION

Figure 1:
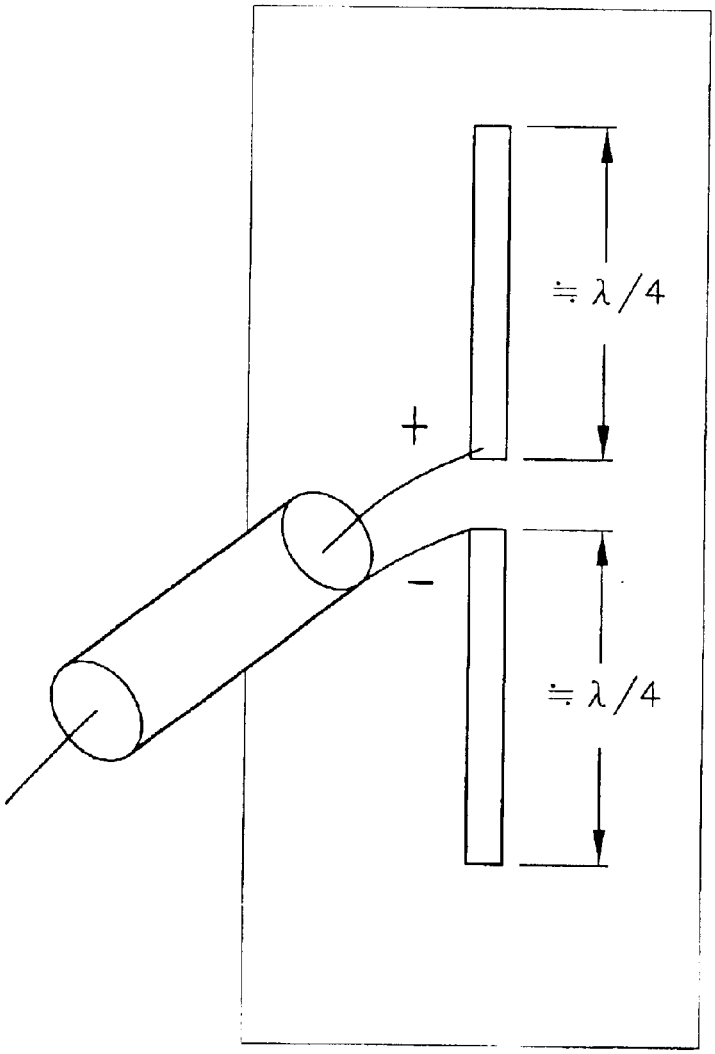
FIG. 1 (PRIOR ART)
FIG. 1 shows a schematic basic structure of a dipole antenna.
Figure 2:
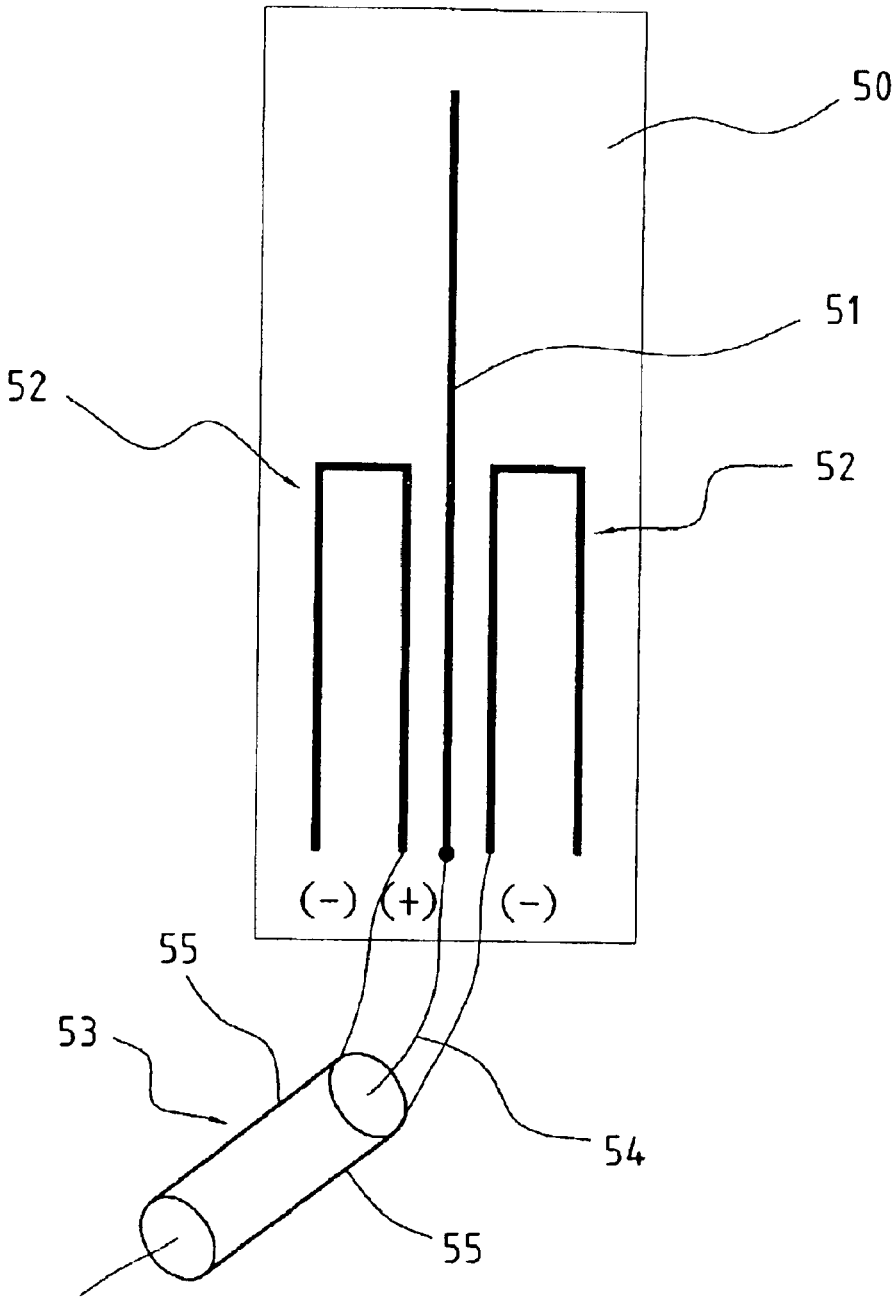
FIG. 2 (PRIOR ART)
FIG. 2 shows a schematic structure of a conventional dipole antenna.
Figure 3:
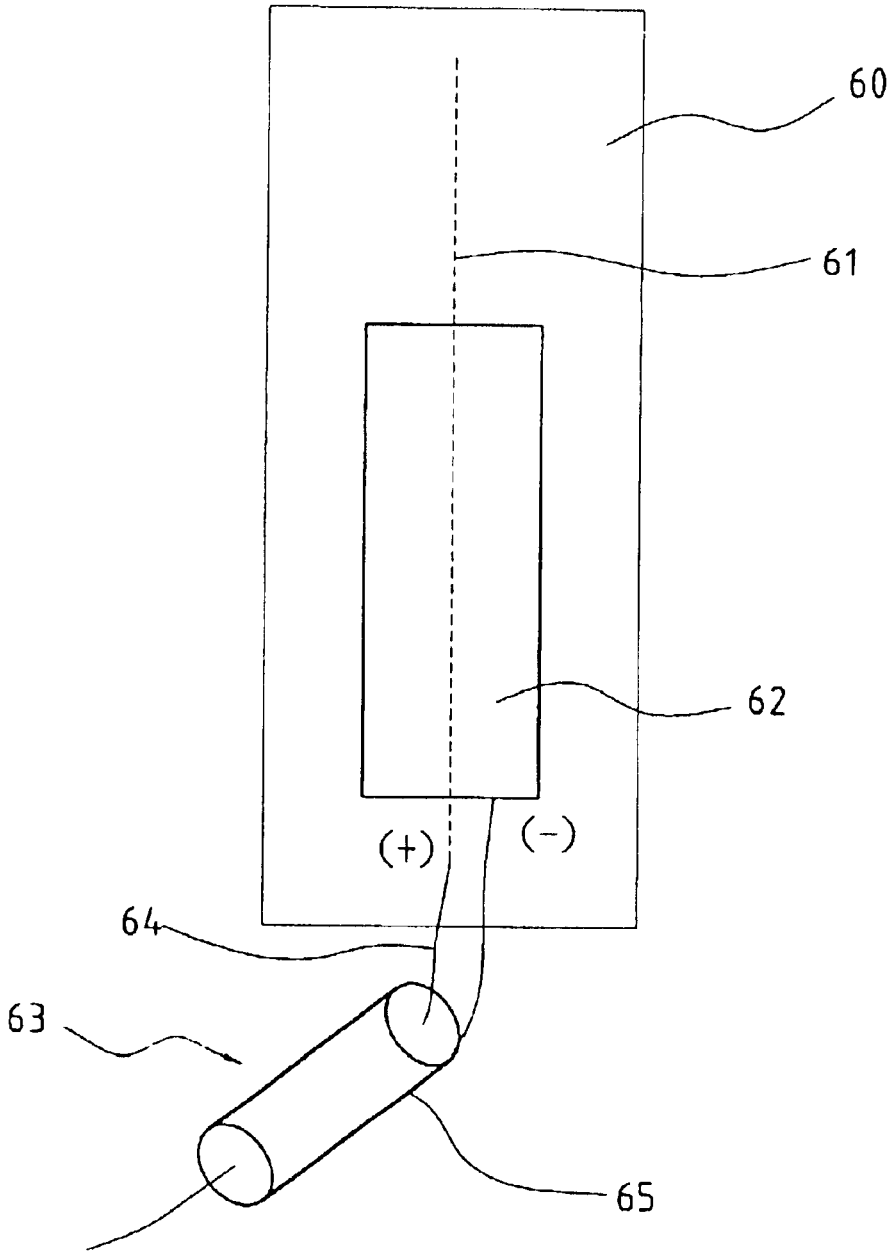
FIG. 3 (PRIOR ART)
FIG. 3 shows a schematic configuration of this invention.
Figure 4:
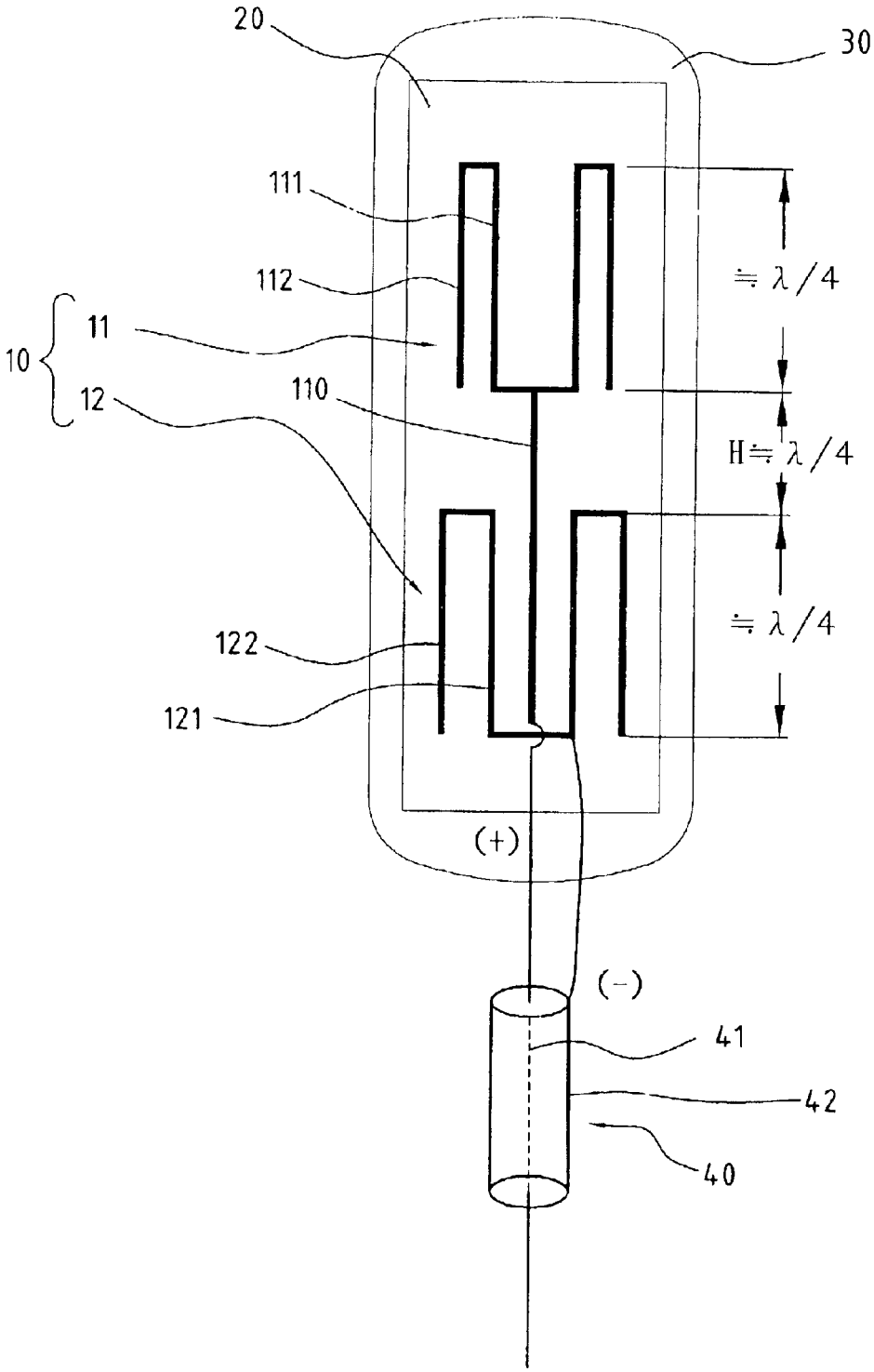
FIG. 4 shows another schematic configuration of this invention.

As the configuration shown in FIG. 4, this invention is a broadband dual-frequency tablet antenna, composed of a set of dipole antennas 10, a baseplate 20, and an inductive investing-piece 30.

The set of dipole antennas 10 has a positive and a negative pole 11, 12 which are substantially flexible narrow straps disposed on the baseplate 20, in which the positive pole 11 includes two inner lateral straps 111 in parallel, in which respective bottom ends are connected to each other, and the top ends are bent outwardly first, then downwardly and extended to form respective outer lateral straps 112. The outer lateral straps 112 are set in parallel to the inner lateral straps 111 such that their bottom ends are correspondent to each other. Similarly, the negative pole 12 also includes two parallel inner lateral narrow straps 121 having their top ends bent outwardly first, then downwardly and extended to form respective outer lateral straps 122, in which the outer lateral straps 122 are set parallel with the inner lateral straps 121. The distance measured from the top to the end of the positive and the negative 11, 12 is about ¼λ of a low-frequency band (λ=wavelength), where the distance (H) from the bottom end of the positive pole 11 to the top end of the negative pole 12 is about ¼λ of a high-frequency band.

The baseplate 20 is substantially a flat circuit board for loading those positive and negative poles 11, 12 thereon. The baseplate 20 could be a ceramic board.

The inductive investing-piece 30 can be made in an insulating material, such as plastics, resin, Teflon, etc.

When assembling, a lead wire 110 jointed with the bottom end of the positive pole 11 is connected to the core 41 of a coaxial cable 40 and the bottom end of the negative pole 12 is connected to the metallic woven shield 42 of the coaxial cable 40. Then, the set of dipole antennas 10 and baseplate 20 is integrally enveloped in the inductive investing-piece 30.

In an embodiment of this invention, the set of dipole antennas 10 is supposed to transmit and receive signals of a low-frequency band, in which, as mentioned, the positive antenna 11 and the negative antenna 12 are spaced out ¼λ according to the center-frequency wavelength in a high-frequency band, so that a signal which creates harmonic oscillation in low frequency will bring up harmonic oscillation in a high-frequency band to hence perform a dual-frequency radiation. Furthermore, by adjusting the flexible configuration of those positive and negative poles 11, 12, or the width of the narrow straps, or the interval between the narrow straps, for example: the interval between the inner lateral narrow straps 111 of the positive pole 11; between the outer lateral narrow straps 112; between the inner and the outer lateral narrow straps 111, 112; between the inner lateral narrow straps 121 of the negative pole 12; between the outer lateral narrow straps 122 of the negative pole 12; or between the inner and the outer lateral narrow straps 121, 122, such that a high-frequency harmonic oscillation will be induced when a low-frequency harmonic oscillation occurs. Also, by mating with the inductive investing-piece 30 that covers the outer surface of the antenna, the low/high 'frequency band for harmonic oscillation is hence effectively widened.

Figure 5:
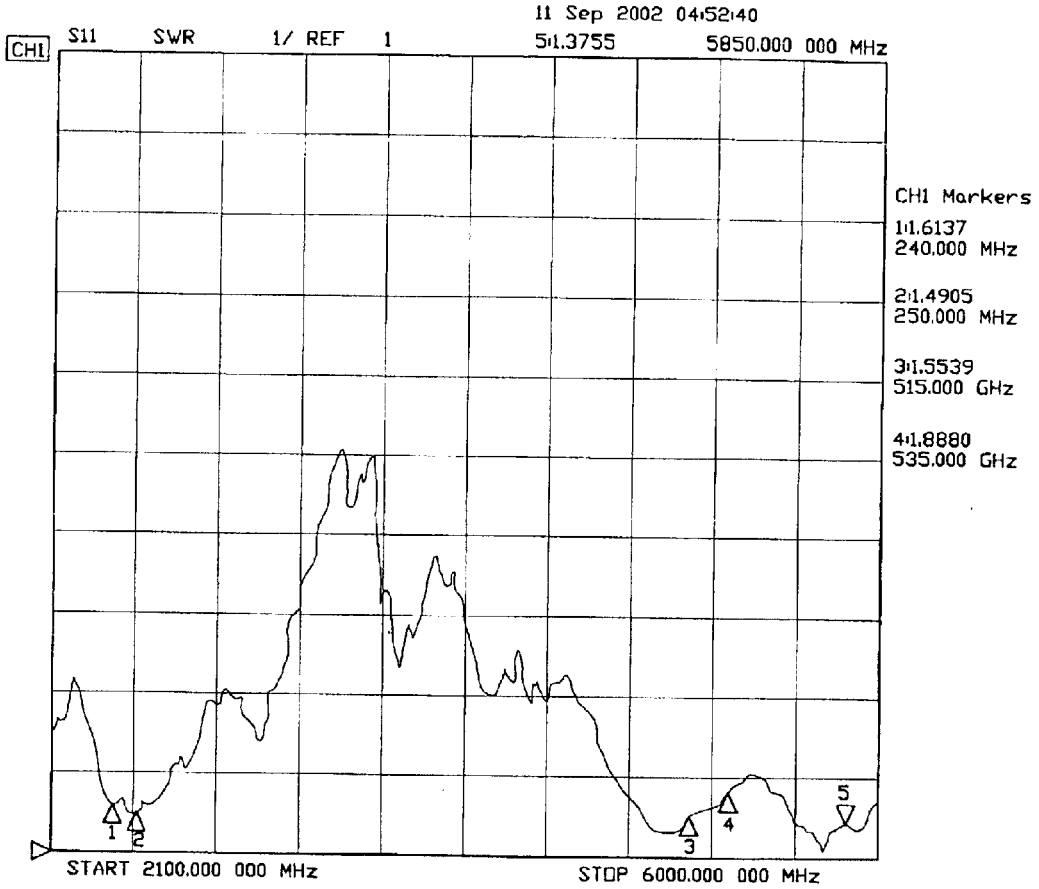
FIG. 5 shows a plotted VSWR curve of an embodiment of this invention.
Figure 6:
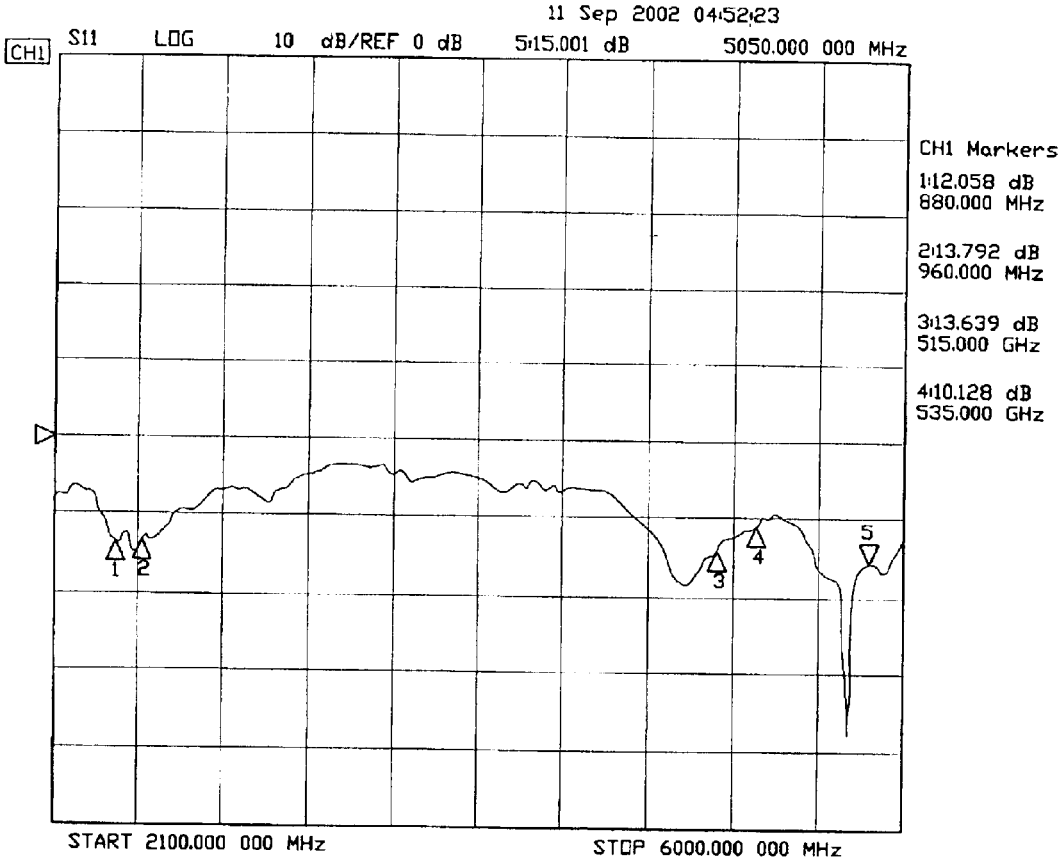
FIG. 6 shows a plotted curve of Return Loss of the embodiment of this invention.

The test data of an IEEE802.11A+B dual-frequency antenna specimen of this invention are plotted in FIG. 5 and FIG. 6, revealing, according to the shown VSWR (voltage standing-wave ratio) and Return Loss curve, that the bandwidth is about 450 MHz (2.25~2.75 GHz) nearby 2.7 GHz and another bandwidth is about 1.0 GHz (4.90~5.90 GHz), namely 1000 MHz, nearby 5.0 GHz. Thus, the effective bandwidth of this invention occupies approximately 18% of the entire channel that tells an improved broadband dual-frequency antenna is realized as expected.

Besides, there is also found an applicable band having bandwidth about 60 MHz nearby 5.50 GHz. Though this bandwidth has a SWR value (2.05) exceeding over the limit value 2.0 according to 802.11A, it is still practicable.

Figure 7:
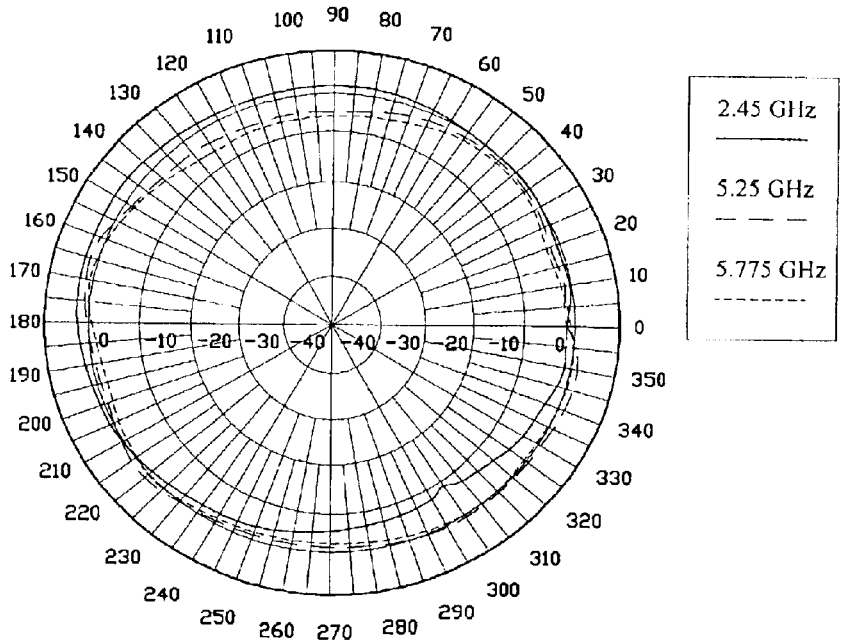
FIG. 7 shows a radiation field in H-plane of the embodiment of this invention.
Figure 8:
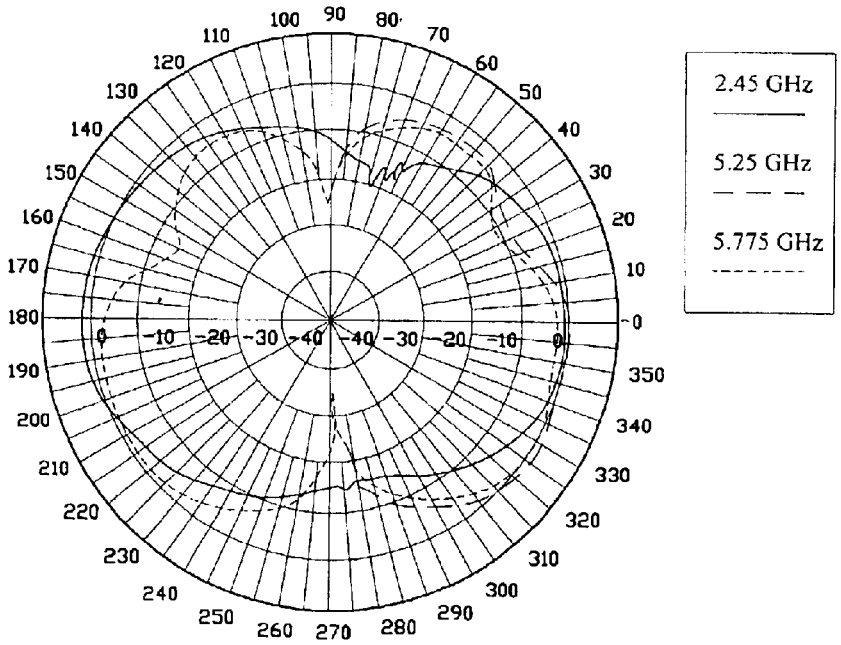
FIG. 8 shows a radiation field in E-plane of the embodiment of this invention.

Now, referring to FIGS. 7 and 8, respective radiation fields of H-plane and E-plane are obtained according to the band of 2.45 GHz, 5.25 GHz, and 5.75 GHz, which are self-explanatory regarding the efficacy and gain of this invention.

In the above described, at least one preferred embodiment has been described in detail with reference to the drawings annexed, and it is apparent that numerous changes or modifications may be made without departing from the true spirit and scope thereof, as set forth in the claims below.

What is claimed is:

1. A broadband dual-frequency tablet antenna, comprising mainly a set of dipole antennas, a baseplate, and an inductive investing-piece, in which a positive and a negative pole of said antenna-set disposed on said baseplate are composed of cambered narrow straps, respectively; the pole length is set about ¼λ (wavelength) of a low-frequency band while the space between poles is set about ¼λ (wavelength) of a high-frequency band;

the baseplate is substantially a flat circuit board for loading said poles thereon;

the inductive investing-piece is made of an insulating material;

when assembling, the negative pole is connected to the core while the negative pole to the metallic woven shield, in a coaxial cable, and the construction including the antenna and the baseplate is then entirely invested in the inductive investing-piece; and during application, by adjusting the cambered shape of the poles respectively, width of the narrow straps, interval between the narrow straps, and cooperating with inductance of the investing-piece, the harmonic bandwidth of said antenna could be widened to hence obtain the broadband dual-frequency function of the tablet antenna.

2. The tablet antenna according to claim 1, in which the positive pole includes two inner lateral straps in parallel, in which respective bottom ends are connected to each other, and the top ends are bent outwardly first, then downwardly and extended to form respective outer lateral straps; the outer lateral straps are set in parallel to the inner lateral straps such that their bottom ends are correspondent to each other; similarly, the negative pole also includes two parallel inner lateral narrow straps having their top ends bent outwardly first, then downwardly and extended to form respective outer lateral straps in parallel.

3. The tablet antenna according to claim 1, in which said baseplate is a ceramic plate.

4. The tablet antenna according to claim 1, in which said inductive investing-piece is made of plastics.

5. The tablet antenna according to claim 1, in which said inductive investing-piece is made of resin.

* * * * *